United States Patent [19]

Geven et al.

[11] Patent Number: 4,935,667

[45] Date of Patent: Jun. 19, 1990

[54] HIGH-PRESSURE SODIUM DISCHARGE LAMP COMPRISING A DISCHARGE ARC SHIELDING MEANS

[75] Inventors: Andreas S. G. Geven; Antonius J. G. C. Driessen, both of Eindhoven, Netherlands

[73] Assignee: U.S. Philips Corporation, New York, N.Y.

[21] Appl. No.: 743,251

[22] Filed: Jun. 11, 1985

[30] Foreign Application Priority Data

Jun. 12, 1984 [NL] Netherlands ..... 8401848

[51] Int. Cl.[5] ..... H01J 61/10

[52] U.S. Cl. ..... 313/631; 313/613

[58] Field of Search ..... 313/240, 333, 335, 613, 313/626, 631, 25

[56] References Cited

U.S. PATENT DOCUMENTS 4,061,939 12/1977 Strok, Jr. ..... 313/25

FOREIGN PATENT DOCUMENTS 2066558A 7/1981 United Kingdom .

*Primary Examiner*—Kenneth Wieder

*Attorney, Agent, or Firm*—Brian J. Wieghaus

[57] ABSTRACT

In the high-pressure sodium discharge lamp according to the invention, the electrodes (17) are surrounded by a hollow cylindrical body (18), which limits an annular space accommodating an electron emitter (19). The cylindrical body (18 l) extends against the current conductor (6) supporting the electrode (17). Means for screening the electron emitter (19) are provided at the end of the annular space facing the electrode tip (20). A shield (21) extends from against the electrode tip (20) laterally beyond the hollow cylindrical body (18).

21 Claims, 1 Drawing Sheet

HIGH-PRESSURE SODIUM DISCHARGE LAMP COMPRISING A DISCHARGE ARC SHIELDING MEANS

The invention relates to a high-pressure sodium discharge lamp provided with a ceramic lamp vessel which is sealed in a vacuum-tight manner and has a filling comprising mercury, sodium and a rare gas. Two electrodes are arranged in the vessel, and are being supported by a respective current conductor passed through the end wall of the lamp vessel and surrounded by a respective hollow cylindrical body. The cylindrical body defines an annular space around the electrode in which an electron emitter is accommodated. The lamp is further provided with means for screening the electron emitter, arranged at the end of this space facing the electrode tip. Such a lamp is known from British Patent 2,066,558.

In the known lamp, the electrodes are each wound with a multispiral of tungsten wire coated with an electron emitter. The wire coated with the electron emitter is situated in an annular space around the electrode, which is limited by a hollow cylindrical body of helically wound tungsten wire. A helically wound wire provided at the end facing the electrode tip of the annular space accommodating the electron emitter screens the emitter at that end from the space in which the discharge takes place during operation. However, the annular space is open at its end remote from the electrode tip.

In a high-pressure sodium discharge lamp, solid or liquid constituents of a lamp filling are present at the coldest spot in the lamp vessel. In general, the spot at which a current conductor enters from the wall of the lamp vessel is the coldest spot. The temperature of that spot determines the vapour pressure of the constituents which are condensed there. If this temperature is too low, the vapour pressure is also too low.

In a lamp of the kind described in the opening paragraph, the coldest spot has too low a temperature and is situated at a current conductor. Moreover, it has been found that, when the lamp is made operative, the discharge arc attacks at the condensed filling constituents. The point of attack of the discharge arc then creeps after some time slowly along the cylindrical body to the electrode tip. Consequently, a fairly long time elapses before the discharge arc is stable. It is observed that the lamp vessel locally becomes black.

The invention has for its object to provide a lamp the discharge arc of which attacks at the electrode tip a short time after the ignition, the lamp vessel of which blackens only slightly and the cold spot of which has a comparatively high temperature.

According to the invention, this object is achieved in a lamp of the kind described in the opening paragraph in that the electrodes are each provided with a shield which is situated at the end of the annular space facing the electrode tip and extends laterally beyond the hollow cylindrical body, and in that this body extends against the current conductor.

It has been found that due to these measures, the temperature of the coldest spot is higher and that further upon ignition of the lamp the point of attack of the discharge arc is displaced very quickly from the condensed constituents of the lamp filling to the circumference of the shield and thence to the electrode tip.

The shield may be a separate body; or it may also be integrated with the means for screening the annular space accommodating the electron emitter or with the hollow cylindrical body, or with both the means for screening and the cylindrical body. The shield may consist of foil material, but may also consist of a spiralized wire. In general, the shield and the hollow cylindrical body at least mainly consist of tungsten.

The diameter of the shield is not critical with the understanding that the shield has to project beyond the hollow cylindrical body. In many lamp constructions, the electrode is introduced through an opening in the wall of the lamp vessel during the manufacture of the lamp. The current conductor fits with a certain amount of clearance into this opening. The opening is then closed. In these lamp constructions, the electrode with the bodies disposed on it has a diameter which is at most as large as the diameter of the current conductor.

An embodiment of the lamp according to the invention is shown in the accompanying drawing. In the drawing.

Figure 1:
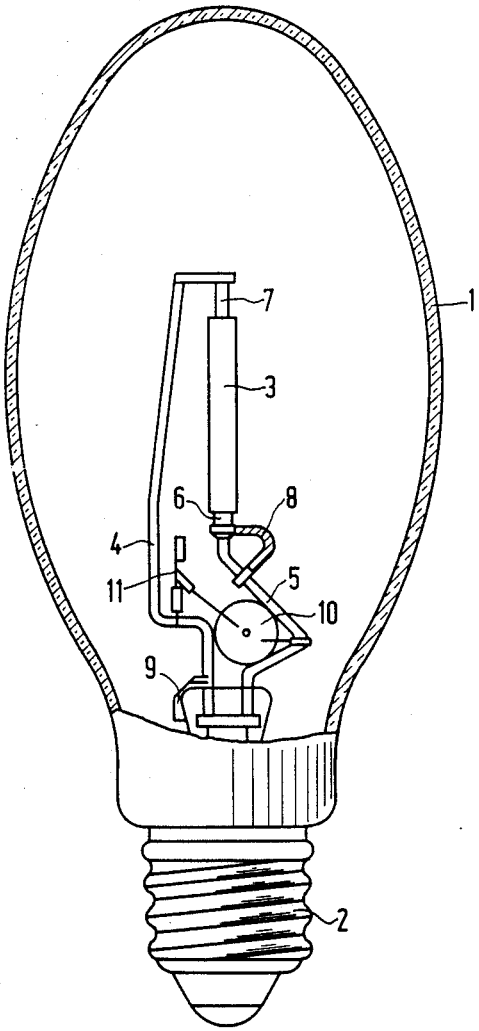
FIG. 1 is a side elevation of a lamp whose outer bulb is broken away.

In FIG. 1, a ceramic lamp vessel 3 sealed in a vacuum-tight manner is arranged in a glass outer bulb 1 provided with a lamp cap 2 between current supply conductors 4 and 5. The lamp vessel has a filling comprising mercury, sodium and a rare gas.

Niobium sleeves 6 and 7 are passed as current conductors through the wall of the lamp vessel and support therein a pair of electrodes. The current supply conductor 5 is passed with a certain amount of clearance into the niobium sleeve 6. A satisfactory electrical contact between this conductor and this sleeve is ensured by a Litze wire 8.

There is a vacuum in the outer bulb, which is maintained by the barium getter evaporating from the ring 9. In the outer bulb a glow starter 10 is arranged in series with a bimetal switch 11, which together shunt the discharge path in the lamp vessel 3. Upon ignition of the lamp, a glow discharge is produced in the glow starter 10. After this glow discharge has extinguished due to increase in temperature in the glow starter, a voltage pulse is provided across the lamp vessel 3, which causes the lamp to ignite. The heat emitted by the discharge opens the bimetal switch 11.

Figure 2:
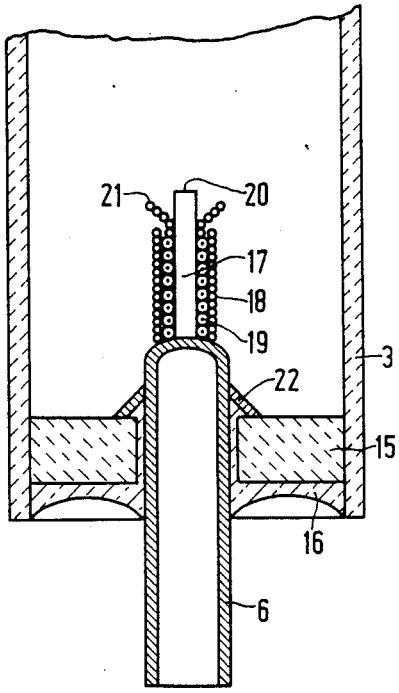
FIG. 2 is a longitudinal sectional view of an end of the lamp vessel of FIG. 1.

In FIG. 2, the lamp vessel 3 is closed at its end by a ring 15 of ceramic material. A niobium sleeve 6 is passed as a current conductor through the ring 15 and is connected to it by a fusion material 16.

The ring 15 and the lamp vessel 3 may consist of a mono- or polycrystalline material, such as, for example, saphhire, aluminum oxide, yttrium aluminum garnet.

The current conductor 6 carries a tungsten electrode 17 surrounded by a hollow cylindrical body 18 consisting of helically wound tungsten wire. The body 18 defines an annular space which accommodates an electron emitter includes a multispiral 19 of tungsten wire coated with an electron emitter substance, for example $Ba_2CaWO_6$. The electron emitter is screened at the end facing the electrode tip 20 of that annular space from the discharge which terminates during operation at the tip 20 of the electrode 17.

The electrode 17 has a shield 21 which is disposed at the end facing the electrode tip 20 of the annular space, which accommodates the wire 19 coated with the electron emitter. The shield 21 shown is a spiralized tungsten wire which grips around the electrode 17 with two turns. The shield 21 forms the means which screen the electron emitter from the discharge arc. The helically wound wire 18 extends against the current conductor 6. Sodium amalgam 22 is deposited against this current conductor.

Upon ignition of the lamp, the discharge arc transiently attacks at the current conductor 6 and then jumps to the shield 21 and subsequently to the electrode tip 20.

What is claimed is:

1. A high-pressure sodium discharge lamp comprising:

a ceramic lamp vessel sealed in a vacuum-tight manner, and having a filling including mercury, sodium and a rare gas;

a pair of current conductors each arranged on an opposing end wall of said lamp vessel and passing through said end wall;

a pair of electrodes disposed within said lamp vessel and each supported by a respective one of said conductors, each of said electrodes having an electrode tip;

a pair of electron emitters each arranged about a respective one of said electrodes, each of said electron emitters including a multispiral of tungsten wire coated with an electron emitter substance;

a pair of cylindrical bodies each consisting of helically-wound wire, each being arranged about a respective one of said electron emitters; and a pair of screening means each disposed on a respective one of said electrodes in the proximity of its electrode tip, each of said screening means extending laterally beyond its respective said cylindrical body;

whereby each of said cylindrical bodies and said screening means combines to shield its respective said electron emitter from discharge arcs, so that upon ignition of said lamp, a discharge arc that strikes at one of said current conductors jumps from said conductor to said screening means to said electrode tip, thereby effectively bypassing said electron emitter.

2. A high-pressure sodium discharge lamp according to claim 1, wherein each of said screening means comprises a respective tungsten wire.

3. A high-pressure sodium discharge lamp according to claim 1, wherein the screening means and cylindrical body arranged on a same electrode are each formed as a respective integral shielding body.

4. A high-pressure sodium discharge lamp according to claim 2, wherein the screening means and cylindrical body arranged on a same electrode are each formed as a respective integral shielding body.

5. A high-pressure sodium discharge lamp comprising:

a ceramic lamp vessel sealed in a vacuum-tight manner, and having a filling including mercury, sodium and a rare gas;

a pair of current conductors each arranged on an opposing end wall of said lamp vessel and passing through said end wall;

a pair of electrodes disposed within said lamp vessel and each supported by a respective one of said conductors, each of said electrodes having an electrode tip;

a pair of electron emitters each arranged about a respective one of said electrodes, each of said electron emitters including a multispiral of tungsten wire coated with an electron emitter substance;

a pair of cylindrical bodies each consisting of helically-wound wire, each being arranged about a respective one of said electron emitters, each of said cylindrical bodies extending against its respective said current conductor; and a pair of screening means each disposed on a respective one of said electrodes in the proximity of its electrode tip, each of said screening means extending laterally beyond its respective said cylindrical body;

whereby each of said cylindrical bodies and said screening means combines to shield its respective said electron emitter from discharge arcs, so that upon ignition of said lamp, a discharge arc that strikes at one of said current conductors jumps from said conductor to said screening means to said electrode tip, thereby effectively bypassing said electron emitter.

6. A high-pressure sodium discharge lamp according to claim 5, wherein each of said screening means comprises a respective tungsten wire.

7. A high-pressure sodium discharge lamp according to claim 5, wherein the screening means and cylindrical body arranged on a same electrode are each formed as a respective integral shielding body.

8. A high-pressure sodium discharge lamp according to claim 6, wherein the screening means and cylindrical body arranged on the same electrode are each formed as a respective integral shielding body.

9. A high pressure sodium discharge lamp comprising: a ceramic lamp vessel sealed in a vacuum-tight manner, and having a filling including mercury, sodium and a rare gas; a current conductor passed through a wall of the lamp vessel; an electrode rod disposed within said lamp vessel, supported by said current conductor, and having an electrode tip; and electron emitter arranged about said electrode rod; an outermost cylindrical body arranged about said electrode rod and defining a space in which said electron emitter is accommodated; and screening means for screening a face of said electron emitter nearest said electrode tip from destructive discharge arcs; wherein the improvement comprises said screening means comprising a shield in the proximity of said electrode tip extending laterally beyond said cylindrical body, whereby said shield facilitates the jumping of striking discharge arcs to said electrode tip.

10. A high-pressure sodium discharge lamp as claimed in claim 9, wherein said shield diverges outwardly from said electrode tip and extends laterally beyond said cylindrical body.

11. A high-pressure sodium discharge lamp as claimed in claim 10, wherein said shield diverges outwardly in a substantially conical form at an acute angle relative to the longitudinal axis of said electrode rod.

12. A high-pressure sodium discharge lamp according to claim 11, wherein said screening means and cylindrical body arranged on a same electrode are each formed as a respective integral shielding body.

13. A high pressure sodium discharge lamp as claimed in claim 12, wherein said cylindrical body extends against and contacts with said current conductor.

14. A high pressure sodium discharge lamp as claimed in claim 13, wherein said screening means is spiralized wire.

15. A high pressure sodium discharge lamp as claimed in claim 14, wherein said screening means is tightly spiralized wire.

16. A high-pressure sodium discharge lamp according to claim 15, wherein said screening means comprises tungsten wire.

17. A high-pressure sodium discharge lamp according to claim 9, wherein said screening means and cylindrical body arranged on a same electrode are each formed as a respective integral shielding body.

18. A high pressure sodium discharge lamp as claimed in claim 9, wherein said cylindrical body extends against and contacts with said current conductor.

19. A high pressure sodium discharge lamp as claimed in claim 9, wherein said screening means is spiralized wire.

20. A high pressure sodium discharge lamp as claimed in claim 9, wherein said screening means is tightly spiralized wire.

21. A high-pressure sodium discharge lamp according to claim 9, wherein said screening means comprises tungsten wire.

* * * * *